US006569265B1

(12) United States Patent
Anderson et al.

(10) Patent No.: US 6,569,265 B1
(45) Date of Patent: May 27, 2003

(54) ELECTRICAL STEEL WITH IMPROVED MAGNETIC PROPERTIES IN THE ROLLING DIRECTION

(75) Inventors: Jeffery P. Anderson, Macedonia, OH (US); Barry A. Lauer, Macedonia, OH (US)

(73) Assignee: International Steel Group Inc., Richfield, OH (US)

( * ) Notice: Subject to any disclaimer, the term of this patent is extended or adjusted under 35 U.S.C. 154(b) by 0 days.

(21) Appl. No.: 09/654,312

(22) Filed: Sep. 1, 2000

Related U.S. Application Data

(60) Division of application No. 09/105,802, filed on Jun. 19, 1998, now Pat. No. 6,231,685, which is a continuation-in-part of application No. 08/579,745, filed on Dec. 28, 1995, now Pat. No. 5,798,001.

(51) Int. Cl.[7] ..... H01F 1/147
(52) U.S. Cl. ..... 148/307; 148/306
(58) Field of Search ..... 148/306, 307, 148/308, 309, 310, 311; 420/117

(56) References Cited

U.S. PATENT DOCUMENTS

| | | | | |
|---|---|---|---|---|
| 3,415,696 A | | 12/1968 | Gimigliano | |
| 3,990,924 A | | 11/1976 | Matsumoto et al. | |
| 4,318,758 A | | 3/1982 | Kuroki et al. | |
| 4,339,287 A | | 7/1982 | Matsumoto et al. | |
| 4,422,061 A | | 12/1983 | Yamamoto et al. | |
| 4,466,842 A | | 8/1984 | Yada et al. | |
| 4,493,739 A | | 1/1985 | Fujiwara et al. | |
| 4,632,708 A | | 12/1986 | Konno et al. | |
| 4,698,272 A | * | 10/1987 | Inokuti et al. | 428/627 |
| 4,770,720 A | | 9/1988 | Kobayashi et al. | |
| 4,897,131 A | * | 1/1990 | Wada et al. | 148/308 |
| 4,963,197 A | * | 10/1990 | Nishiike et al. | 148/111 |
| 4,997,493 A | | 3/1991 | Ushigami et al. | |
| 5,028,279 A | | 7/1991 | Wada et al. | |
| 5,125,991 A | * | 6/1992 | Ishitobi et al. | 148/308 |
| 5,141,573 A | | 8/1992 | Nakashima | |
| 5,143,561 A | | 9/1992 | Kitamura et al. | |
| 5,223,048 A | * | 6/1993 | Inokuti | 148/307 |
| 5,342,454 A | | 8/1994 | Hayakawa et al. | |
| 5,413,639 A | | 5/1995 | Sato et al. | |
| 5,415,703 A | | 5/1995 | Ushigami et al. | |
| 5,798,001 A | | 8/1998 | Anderson | |

FOREIGN PATENT DOCUMENTS

| | | |
|---|---|---|
| JP | 56-43294 | 10/1981 |

OTHER PUBLICATIONS

Article entitled "Effect of temper rolling on texture formation of semi–processed non–oriented steel", authored by T. Shimazu, M. Shiozaki and K. Kawasaki, pp. 147–149, copyright 1991 Elsevier Science B.V.

(List continued on next page.)

*Primary Examiner*—John Sheehan
(74) *Attorney, Agent, or Firm*—Watts Hoffmann Fisher & Heinke

(57) ABSTRACT

A method of making electrical steel strip characterized by low core loss and high permeability in the rolling direction includes the steps of: hot rolling a slab of an electrical steel composition into a strip, hot band annealing in a temperature range effective to coarsen the grains sufficient to improve magnetic properties in a rolling direction of the strip, cold rolling, batch annealing in a temperature range effective to produce a batch annealed grain size of not greater than 40 μm and, preferably not greater than 20 μm, and temper rolling to provide the strip with a transfer surface roughness (Ra) of less than 49 μin. Electrical steel articles are manufactured from the steel strip upon final annealing. The electrical steel articles have a grain texture including a {110}<001> orientation and improved permeability in the rolling direction.

27 Claims, 3 Drawing Sheets

OTHER PUBLICATIONS

Excerpts from Armco Steel Corporation's manual on oriented steels, pp. 14 and 36, "Armco Oriented Electrical Steels", copyright 1974.

Thesis by Rodolfo Arroyo, submitted in its entirety, entitled "Correlation of Texture with Magnetic Properties in Lamination Steels", Aug. 1982.

Thesis by Rodolfo Arroyo, submitted in its entirety, entitled "Effects of Processing Parameters on the Textures of Lamination Steels", Dec. 1986.

Thesis by Chen–Chung, Steve Chang, submitted in its entirety, entitled "Effects of Surface Article Elements on the Texture Development in Lamination Steels", Dec. 1985.

* cited by examiner

ELECTRICAL STEEL WITH IMPROVED MAGNETIC PROPERTIES IN THE ROLLING DIRECTION

RELATED APPLICATIONS

This application is a Divisional of application Ser. No. 09/105,802, filed Jun. 19, 1998, now U.S. Pat. No. 6,231,685 which is a Continuation-In-Part of application Serial No. 08/579,745, filed Dec. 28, 1995 now U.S. Pat. No. 5,798, 001.

TECHNICAL FIELD

The present invention relates generally to electrical steels, and more specifically, to motor lamination steels having improved magnetic properties in the rolling direction, as well as good mechanical properties.

BACKGROUND OF THE INVENTION

Desired magnetic properties of steels used for making motor and transformer laminations are low core loss and high permeability. Those steels which are stress relief annealed after punching should have mechanical properties which minimize distortion, warpage and delamination during the annealing of the lamination stacks.

Continuously annealed silicon steels are conventionally used for motors, transformers, generators and similar electrical products. Continuously annealed silicon steels can be processed by techniques well known in the art to obtain low core loss and high permeability. Since the steels are substantially free of strain, they can be used in the as-punched condition (commonly referred to as fully processed steels) or can be finally annealed by the electrical apparatus manufacturer after punching of the laminations (commonly referred to as semi-processed steels) to produce the desired magnetic properties with little danger of delamination, warpage, or distortion. Continuous annealing processing requires the electrical steel sheet manufacturer to have a continuous annealing facility. The equipment for a continuous annealing facility requires a capital expenditure of many millions of dollars.

To avoid a continuous annealing operation, practices have been developed to produce cold rolled motor lamination steel by normal cold rolled sheet processing including batch annealing followed by temper rolling. Continuous annealing processes differ in many respects from normal cold rolled sheet processing. For example, continuous annealing subjects the coil to uniform annealing conditions, whereas batch annealing does not.

In addition, a continuously annealed product does not require temper rolling for flattening, because when steel is continuously annealed it has little strain imparted to it from the annealing process. Although batch annealing facilities use much lower cost equipment than continuous annealing facilities, batch annealing facilities are not able to produce a sufficiently flat product without temper rolling. Strain imparted by temper rolling leads to the delamination and warpage problems of motor lamination steel. At the present time, delamination and warpage resulting from this strain is a serious concern to such customers.

Steel can be produced to have either "oriented" grains, or "non-oriented" grains. Grain oriented silicon steels are characterized by very light permeability and low core loss in the rolling direction. For example, at 1.5 Tesla ("T") and 60 Hertz ("Hz"), a 0.012 inch thickness strip may have a permeability in the rolling direction of 28,000 Gauss/Oersted ("G/Oe") and a core loss in the rolling direction of 0.58 Watts/pound ("W/lb").

Grain oriented silicon steels have superior magnetic properties in the rolling direction as a result of a so-called Goss texture, i.e., a {110}<001> orientation as defined by the Miller crystallographic indexing system. Steel having a Goss texture is magnetically anisotropic, i.e., it has a sheet-plane variation of permeability and core loss from the rolling direction (0°) to the transverse direction (90°). In grain oriented steel, the rolling direction coincides with the easily magnetizable <001> crystal axes and the grains in the steel occupy a very sharp {110}<001> texture. It is generally believed to be desirable for grain oriented steel to have a substantially complete Goss texture. To this end, an average displacement angle of individual grains from the {100}<001> orientation is as small as possible, for example within 3°.

A typical process for making grain oriented silicon steel generally includes hot rolling a high alloy steel, containing about 3% or more by weight of silicon. The steel is then solution annealed to dissolve second phase particles and is closely control cooled to produce fine second phase precipitates. Next, there is a two-stage cold reduction, with an intermediate annealing operation. The cold rolled sheets are then primarily recrystallized in a decarburizing atmosphere to remove particles that inhibit grain growth. Secondary recrystallization is then employed in order to grow very large grains (<5 millimeters) possessing the Goss texture. For example, see U.S. Pat. No. 5,342,454 to Hayakawa et al.

One disadvantage of grain oriented silicon steels is that they are expensive to manufacture. Grain oriented steel processing typically requires several costly rolling and annealing steps to produce the Goss texture. Moreover, grain oriented steel processing typically requires the use of a continuous annealing facility.

Another disadvantage of grain oriented steel is that it has poor magnetic properties off-angle from the rolling direction in the plane of the strip. In grain oriented steels, permeability is about 28000 G/Oe in the rolling direction (0°) and only about 500 G/Oe in the transverse direction (90°). See the brochure, Armco Oriented Electrical Steels, copyright 1974, Armco Steel Corporation, pages 14 and 36, which is incorporated by reference herein, for typical permeabilities and core losses for grain oriented steel in the rolling direction and off-angle from the rolling direction. Grain oriented steel exhibits a very steep drop in permeability even slightly off-angle from the rolling direction. For example, a typical grain oriented steel has a greater than 50% reduction in permeability between the permeability in the rolling direction and the permeability at 10° from the rolling direction.

An inconvenience of using grain oriented steel is that the permeability is so high it may create problems in some devices. For example, transformer light ballast manufacturers have indicated that typical grain oriented material is undesirable in fluorescent light ballasts because it causes a humming sound when the device is operated.

Conventional non-oriented cold rolled sheet processing includes the steps of hot rolling, coiling, pickling, optional hot band annealing, cold rolling, batch annealing and temper rolling. The equipment for such non-oriented processing costs much less than the equipment for a continuous annealing facility. Non-oriented steel processing often employs compositions that desirably have less silicon than grain oriented steel compositions. However, non-oriented steel has a mostly random distribution of orientations. That is, the magnetically "soft" <001> directions occupy a fairly uniform distribution in space, not only in the plane of the sheet but also pointing into and out of the sheet where they participate only minimally in the magnetization process. As a result, non-oriented steel does not exhibit a significant improvement of magnetic properties in the rolling direction.

SUMMARY OF THE INVENTION

The present invention utilizes the low-cost attributes of traditional non-oriented processing of cold rolled electrical steels to produce a new class of steel having the Goss texture found in expensive higher alloy grain oriented materials. The steel produced in accordance with the invention has exceptional magnetic properties in the rolling direction, as well as good magnetic properties across a broad range of angles from the rolling direction in the plane of the strip.

Generally, the method of the present invention employs a slab of an electrical steel composition. The composition has up to 2.25% silicon by weight and, in particular, 0.20–2.25% silicon by weight. The composition has up to 0.04% carbon by weight, preferably up to 0.01% carbon by weight. The slab is hot rolled into a strip, which is subjected to steps including hot band annealing in a temperature range effective to coarsen grains sufficient to improve magnetic properties in a rolling direction of the strip, cold rolling, batch annealing in a temperature range effective to produce batch annealed grains of a size not greater than about 40 $\mu$m, even more preferably of a size not greater than about 20 $\mu$m (corresponding to a temperature preferably ranging from 1040°–1140° F.), and temper rolling with smooth temper rolls. The temper rolls have a smooth surface that is effective to produce a strip with a transfer surface roughness (Ra) of less than 49 $\mu$in (wherein "$\mu$" is the Greek symbol "micro" which means $1\times10^{-6}$) as well as an increased permeability in the rolling direction after final annealing of preferably at least about 5000 G/Oe. The temper rolls preferably have a smooth surface that is effective to provide the strip with a transfer surface roughness (Ra) of not grater than 15 $\mu$in.

More specifically, electrical steel articles are manufactured from the steel strip by steps including punching out motor or transformer shapes from the strip into laminations, which are then stacked and assembled. The laminations are subjected to a final anneal to produce the electrical steel articles of the present invention. However, as used herein, the electrical steel articles of the invention also include electrical steel strip which has been final annealed after temper rolling without punching into shapes and laminating (such as single strip coupons).

Temper rolling is preferably carried out to reduce strip thickness by an amount up to 10%, even more preferably by an amount ranging from 3 to 10%. Temper rolling may be carried out at smaller reduction in thickness when producing steep strip of smaller thicknesses. In this regard, temper rolling reductions in thickness may decrease by about .7% for each 0.01 inch of a reduction in final thickness of the strip.

A preferred method in accordance with the invention for making electrical steel strip for use in the manufacture of electrical steel articles characterized by low core loss and high permeability in the rolling direction, comprises the steps of:

hot rolling a slab of an electrical steel composition into a strip, hot band annealing in a temperature range effective to coarsen grains sufficient to improve magnetic properties in a rolling direction of the strip, cold rolling, batch annealing at a temperature in the range of 1040–1140° F., and temper rolling to provide the strip with a transfer surface roughness (Ra) of not greater than 15 $\mu$in.

Electrical steel articles of the present invention manufactured from the steel strip upon a final anneal, have a grain texture including a {110}<001> orientation, and a transfer surface roughness (Ra) of less than 49 $\mu$in, preferably not greater than 15 $\mu$in. The inventive electrical steel articles preferably have a permeability in the rolling direction of at least 5000 G/Oe, more specifically, a permeability in the rolling direction in the range of 5000–6500 G/Oe. The core loss is preferably not greater than 1.5 W/lb in the rolling direction.

Use of the phase "transfer surface roughness" herein means the surface roughness of the steel strip that has been acquired by contact between the temper rolls and the steel strip. Reference to "smooth" temper rolls herein means rolls that impart to the steel an improved permeability in the rolling direction (e.g., preferably at least 5000 G/Oe) as well as a transfer surface roughness (Ra) of less than 49 $\mu$in and preferably, not greater than 15 $\mu$in. All angles referred to herein are taken in the plane of the steel articles with respect to the rolling direction, which is at 0°, and the transverse direction, which is 90° from the rolling direction.

More specifically, the steel articles exhibit a change in permeability of about 5% between the permeability in the rolling direction and the permeability at 10° from the rolling direction. The permeability is at least 5000 G/Oe across angles ranging from the rolling direction to 18° from the rolling direction. The core loss is not greater than 1.5 W/lb across angles ranging from the rolling direction to 25° from the rolling direction.

The steel of the present invention has magnetic properties similar to those found in conventional grain oriented steel, and does not suffer from delamination and warpage problems. Moreover, the method of the present invention uses features of non-oriented cold rolled sheet compositions and processing to produce a product have characteristics of a grain oriented product. Therefore, the present method is much more economical than conventional grain oriented steel processing because it does not require a continuous annealing facility, additional rolling steps and higher alloys. In addition, the steel articles produced by the present invention have the desirable properties of high permeability and low core loss in the rolling direction.

One significant way in which the present method differs from grain oriented steel processing is in the final annealing step. In both the present method and grain oriented steel processing, annealing is performed to reduce lamination edge strain from the punching operation. However, when the consumer receives the conventional grain oriented product in it semi-processed form, the material already possess the Goss texture, which was developed at the mill. The microstructure, and hence the magnetic properties in the rolling direction, of conventional grain oriented steel do not change appreciably during the stress relief anneal by the customer. In fact, many customers of grain oriented products do not even perform a stress relief anneal.

In the present invention, the final or stress relief anneal is employed primarily to relieve the strain induced by temper rolling. This is not the purpose of the stress relief anneal of grain oriented material, because typically no temper rolling is conducted during grain oriented steel processing that would impart such strain. Moreover, the Goss texture is not developed in the steel of the present invention until this final anneal, which is usually conducted by the customer.

The present invention is directed to a new class of steel that is not comprised of substantially all Goss texture as is grain oriented steel. The steel of the present invention predominantly includes the Goss texture, but has a broader distribution of the Goss texture than typical grain oriented steel. As a result, the steel articles of the present invention exhibit higher permeabilities across a wider range of angles from the rolling direction than typical grain oriented material. This permits steel articles made according to the present invention to have permeabilities of 5000 G/Oe or more across angles ranging from the rolling direction to 18° from the rolling direction. Also, in the present invention the decrease in permeability between the permeability in the rolling direction and the permeability off-angle from the rolling direction is much less than in grain oriented steel. For example, in the present intention the decrease in permeability between the permeability in the rolling direction and the permeability at 10° from the rolling direction is about 5%, which is substantially less than in grain oriented materials.

The steel articles of the present invention are suitably used in any products in which good permeability in the rolling direction is desirable, such as in transformers and ballasts. Because the steel articles of the present invention do not have the extremely high permeability in the rolling direction of typical grain oriented materials, they may be used in fluorescent light ballasts without the humming problems of the prior art. Steel articles of the present invention may also be used in motors in view of the significant cost advantage of the present method.

The foregoing and other features and advantages of the invention are illustrated in the accompanying drawings and are described in more detail in the specification and claims that follow.

DETAILED DESCRIPTION OF PREFERRED EMBODIMENTS

Figure 1A:
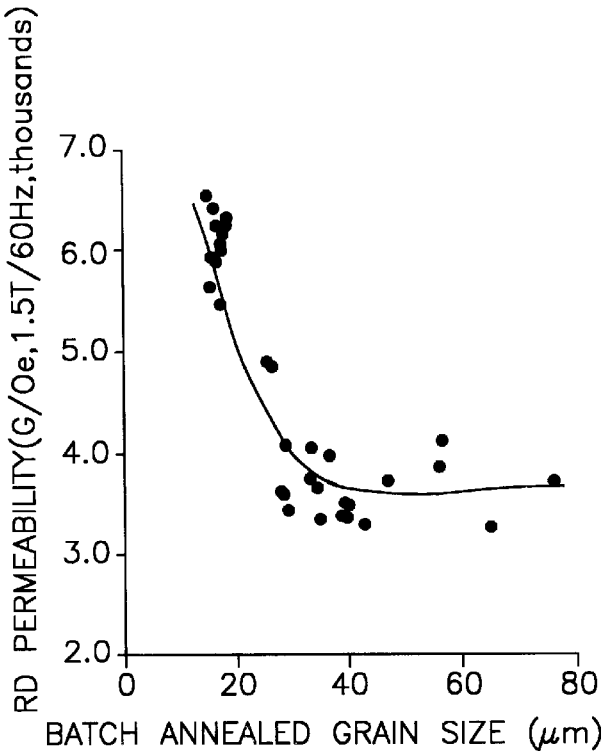
FIGS. 1A and 1B are graphs showing permeability (G/Oe-thousands) and core loss (W/lb) in the rolling direction, as a function of the average batch annealed grain diameter.

A method of making electrical steel strip according to the present invention useful to make electrical steel articles characterized by low core loss and high permeability in the rolling direction, includes the steps of preparing a slab of an electrical steel composition. The composition is characterized by up to 2.25% silicon by weight and preferably, 0.20–2.25% silicon by weight. The composition includes up to 0.04% carbon and, preferably, up to 0.01% carbon. In particular, the composition advantageously employs ultra-low carbon. The composition comprises (% by weight): up to 0.04 carbon (C), 0.20–2.25 silicon (Si), 0.10–0.60 aluminum (Al), 0.10–1.25 manganese (Mn), up to 0.02 sulphur (S), up to about 0.01 nitrogen (N), up to 0.07 antimony (Sb), up to 0.12 tin (Sn), up to 0.1 phosphorus (P), and the balance being substantially iron. More preferably, the composition comprises (% by weight): up to 0.01 C, 0.20–2.25 Si, 0.10–0.45 Al, 0.10–1.0 Mn, up to 0.015 S, up to 0.006 N, up to 0.07 Sb, up to 0.12 Sn, 0.005–0.1 P, more preferably 0.005–0.05 P, and the balance being substantially iron.

The slab is hot rolled into a strip at either a ferrite or an austenite finishing temperature, and is then coiled at a temperature in the range of 900–1500° F., more preferably at about 1000° F. The strip is then preferably scale break rolled and then pickled.

The strip is hot band or "pickle band" annealed at a temperature ranging from 1500–1600° F., cold rolled to 65–85% elongation, batch annealed at a temperature in the range of 1040–1140° F., and temper rolled to a reduction in thickness of the strip ranging from 3–10% and more preferably, 8%. The temper rolling is conducted with smooth rolls that provide the strip with a transfer surface roughness (Ra) of not greater than 15 $\mu$in. The strip is then preferably coated with a material that will prevent adjacent stacked laminations from sticking to each other. Motor or transformer shapes are then punched out of the strip, arranged and stacked in laminations. The stacked laminations are then subjected to a final anneal.

Electrical steel articles manufactured from the steel strip have a grain texture including a {110}<001> orientation, a transfer surface roughness (Ra) of not greater than 15 $\mu$in, and improved permeability in the rolling direction (e.g., permeability in the rolling direction of at least 5000 G/Oe and, preferably, ranging from 5000 to 6500 G/Oe).

Turning now to the specific features of the present method, the steel strip may be passed through a mill typically used to break scale from the strip at the pickle line. The range of hot band anneal temperatures is an essential part of the present invention. The hot band annealing temperature range is that which is effective to coarsen grains sufficient to improve magnetic properties in a rolling direction of the strip. It has been determined that the particular range of hot band anneal temperature of the present invention is critical for coarsening the hot band grains. Coarsening the grains at this point in the processing is important to achieve the magnetic properties of the present invention in the final product. Suitably coarse grains are achieved by conducting hot band annealing at a temperature range of 1500–1600° F. For example, a grain size of 550–600 $\mu$m occurs at a hot band annealing temperature of 1500° F. The grain size upon hot band annealing is as large as possible, preferably at least about 200 $\mu$m, for example, 200–600 $\mu$m.

The importance of the hot band anneal step and the particular temperature range used is shown in the following Table 1. Table 1 shows the magnetic properties for a composition that includes (% by weight): 0.008 C, 0.48 Mn, 0.013 P, 0.005 S, 1.15 Si, 0.31 Al, 0.045 Sb, 0.002 N, and the balance being substantially iron. Slabs of the desired composition were hot rolled with a finishing temperature of 1600° F. The strips were then coiled at the temperatures indicted, rolled in the scale breaking mill to impart a 2% elongation, pickled, either not hot band annealed or hot band annealed at the temperatures indicated for 15 hours (annealing after pickling being referred to as pickle band annealing "PBA"). cold rolled, batch annealed to produce a roughly 20 $\mu$m recrystallized grain size, and temper rolled to a 7.0% reduction in thickness with smooth rolls. Next, the strips were cut into single strip magnetic test coupons and stress relief annealed according to the present invention. The magnetic properties indicated in the table are average magnetic properties from the rolling direction and the transverse direction, taken at 1.5 T and 60 Hz, at 0.018 inch nominal thickness.

TABLE I

| Ex. | Coiling Temp (° F.) | PBA Temp (° F.) | Temper (% elongation) | Perm (G/Oe) | $B_{50}$ (T) | Core Loss (W/lb) |
|---|---|---|---|---|---|---|
| A | 950 | no PBA | 7.0 | 2617 | 1.65 | 1.78 |
| B | 950 | 1400 | 7.0 | 3558 | 1.68 | 1.63 |
| C | 950 | 1500 | 7.0 | 3678 | 1.68 | 1.59 |
| D | 950 | 1600 | 7.0 | 3604 | 1.68 | 1.58 |
| E | 1275 | no PBA | 7.0 | 2377 | 1.65 | 1.84 |
| F | 1275 | 1400 | 7.0 | 3437 | 1.68 | 1.73 |
| G | 1275 | 1500 | 7.0 | 3982 | 1.68 | 1.55 |
| H | 1275 | 1600 | 7.0 | 3527 | 1.68 | 1.68 |

As shown in Table 1, the presence of a hot band annealing step greatly increased permeability and $B_{50}$ values (i.e., magnetic induction achieved when the magnetizing force is 5000 amp-turns/meter) and lowered the core loss. For example, the steel of Example B, which was pickle band annealed, had a permeability of 3558 G/Oe and a core loss of 1.63 W/lb compared to a permeability of 2617 G/Oe and a core loss of 1.78 W/lb for the steel of Example A, which was subjected to the same conditions except for the pickle band anneal. The steels of Examples A and E, which were not pickle band annealed, had lower permeability and higher core loss than the Examples, in which the steel was subjected to a pickle band anneal.

Figure 1B:
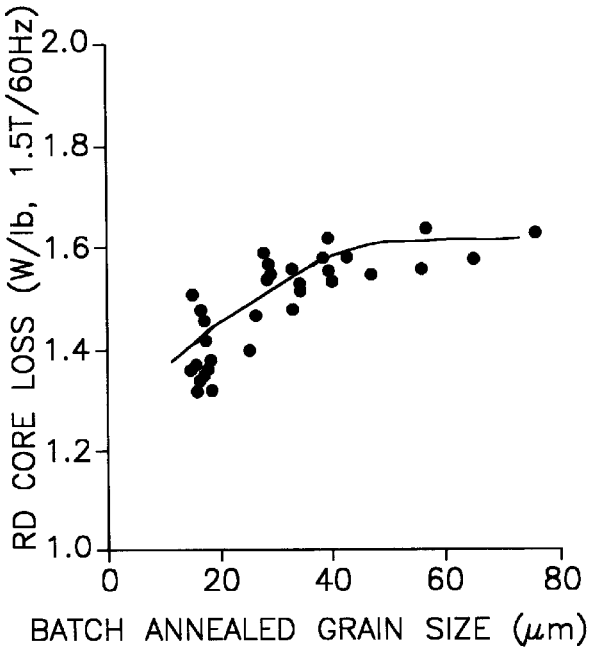

The importance of batch annealing in the present invention and of the particular temperature ranges in which it is conducted are shown in FIGS. 1A and 1B. The process described by FIGS. 1A and 1B employed steel having a composition including (% by weight): 0.004% C, 0.05% Mn, 1.15% Si, and 0.30% Al, and the balance being substantially iron. Slabs were hot rolled into strips with a finishing temperature in the ferrite range (1530° F.). The strips were hot band annealed at 1500° F., tandem rolled, batch annealed for 10 hours at varying soak temperatures to produce a wide range of recrystallized grain size, and temper rolled to a 7% elongation using smooth temper rolls. Single strip magnetic test coupons were cut from the strip and stress relief annealed according to the present invention. The steel was subjected to single strip testing of magnetic properties at 1.5 T and 60 Hz.

A smaller batch annealed grain size resulted from a low batch annealing soak temperature, which was necessary to produce the magnetic properties of the present invention. As seen in FIGS. 1A and 1B the steel showed improved magnetic properties when the average batch annealed grain size was as high as about 40 $\mu$m. There was a significant rise in permeability in the rolling direction (FIG. 1A) and a significant drop in core loss in the rolling direction (FIG. 1B) when the average batch annealed grain size was up to about 20 $\mu$m in diameter. In this particular example, the batch annealed grain size of 20 $\mu$m or less in diameter was the result of a 1125°F. soak temperature. It is critical that batch annealing be performed in the temperature range of 1040–1140° F. and, more preferably, in the temperature range of 1100–1125° F., to produce the magnetic properties of the present invention. However, it will be apparent from this disclosure that an alternative way that the batch annealing temperature range may be characterized is in terms of batch annealed grain size. That is, the batch annealing temperature range is that which is effective to produce a batch annealed grain size of not greater than about 40 $\mu$m and, more preferably, not greater than about 20 $\mu$m. (e.g., see FIGS. 1A and 1B).

FIGS. 1A and 1B suggest that if the curves were extrapolated to show the results of an extremely small batch annealed grain size, very high permeability and very low core loss would be attainable. Using batch annealed grain sizes smaller than 20 $\mu$m is well within the purview of those of ordinary skill in the art in view of this disclosure. After batch annealing, the steel has a substantially complete recrystallization of the cold worked microstructure. In this regard, improvement of magnetic properties in the rolling direction was obtained, for example, even when up to 10% of the grains retained the cold worked microstructure.

Having a smooth surface condition of the temper rolls is critical in the method of the present invention for improving magnetic properties in the rolling direction, as shown by Table II. The method described by Table II employed a material having a composition including (% by weight): 0.004 C, 0.5 Mn, 1.15 Si, 0.30 Al, 0.011 P, 0.004 S, 0.002 O, 0.002 N, 0.022 Sb, and the balance being substantially iron. Slabs having this composition were hot rolled into strips with a finishing temperature of 1530° F. The strips were coiled at 1000° F., hot band annealed at 1500° F. for 15 hours, tandem rolled, batch annealed to produce a recrystallized grain size of roughly 20 $\mu$m at 1230° F. for 10 hours, and then temper rolled with a reduction in thickness of 7.0%. Single strip magnetic test coupons were then cut from the strips and subjected to a stress relief anneal according to the present invention.

Examples I–L used smooth or "bright" temper rolls according to the invention to produce a transfer surface roughness (Ra) in the strip of about 5 $\mu$in. Comparative Examples M–P used conventional rough temper rolls to produce a transfer surface roughnesss (Ra) in the strip of about 49 $\mu$in. The rolling direction magnetic properties were taken by single strip testing at 1.5 T and 60 Hz, at 0.018 inch nominal thickness.

TABLE II

| | Perm. (G/Oe) Core Loss (W/lb) |
|---|---|
| EXAMPLES | |
| I | 4917, 1.49 |
| J | 5734, 1.44 |
| K | 5577, 1.40 |
| L | 5393, 1.50 |
| COMPARATIVE EXAMPLES | |
| M | 1812, 1.84 |
| N | 2128, 1.68 |
| O | 1250, 1.93 |
| P | 1623, 1.88 |

As shown in Table II, there are substantial increases in permeability and decreases in core loss in the rolling direction when smooth temper rolls are used rather than rough temper rolls. The lowest permeability of the invention using smooth rolls in Example I (4917 G/Oe) was over 100% greater than the highest permeability of using rough rolls in Comparative Example N (2128 G/Oe).

Figure 2A:
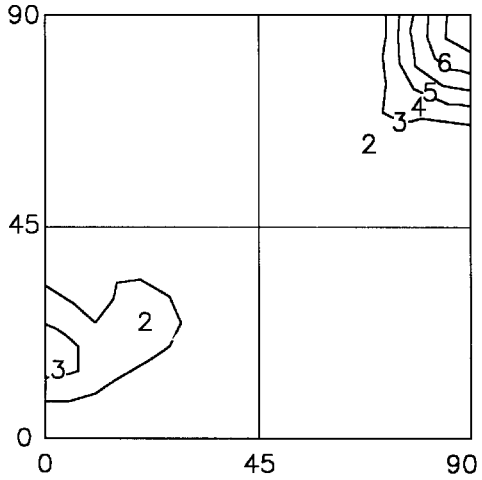
FIG. 2A is an orientation density map showing the as-stress relief annealed Goss texture in a representative "smooth-roll" temper at 10% below the surface in steel produced according to the present invention.
Figure 2B:
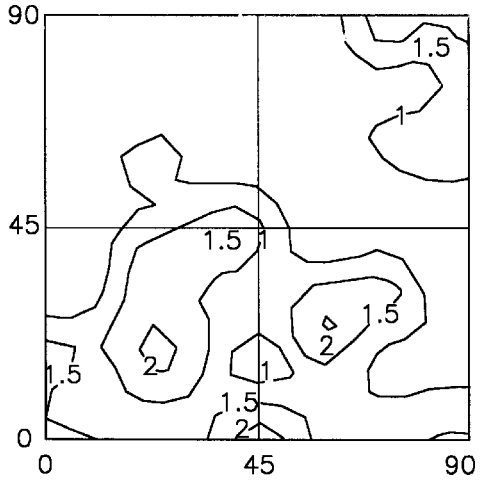
FIG. 2B is an orientation density map showing the as-stress relief annealed texture at 2% below the surface in a representative "rough-roll " temper.

FIG. 2A shows the texture that occurs when temper rolls having a smooth surface finish are used, and FIG. 2B shows the texture that occurs when temper rolls having a rough surface finish are used. FIG. 2A confirms the presence of Goss texture in the steel produced according to the present invention when smooth temper rolls are used. FIG. 2B shows that the Goss texture is not obtained using rough temper rolls.

Figure 3A:
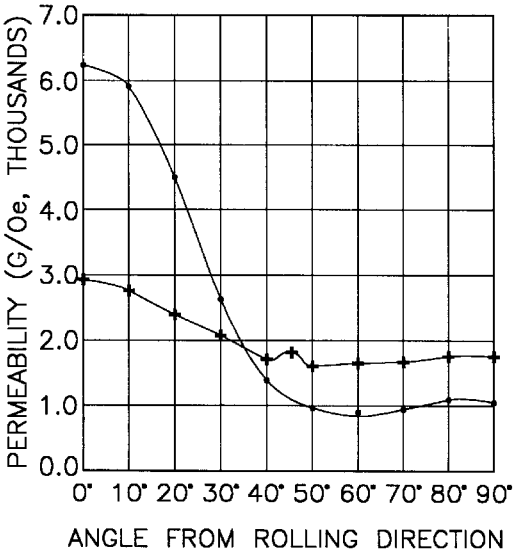
FIGS. 3A and 3B are graphs showing permeability (G/Oe-thousands) and core loss (W/lb), respectively, as a function of the angle from the rolling direction.
Figure 3B:
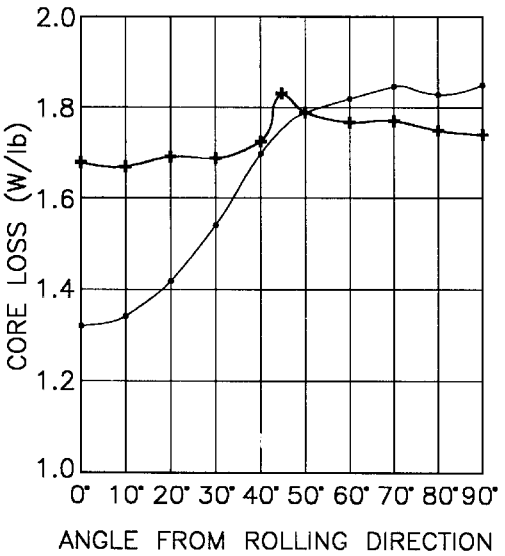

FIGS. 3A and 3B show the magnetic anisotropy of steel articles produced according to the invention (shown by the curve having data points represented by ●'s) compared to comparative steel articles that were batch annealed at 1230° F. and temper rolled to have a rough transfer surface roughness (Ra) of 50 μin (shown by the curve having data points represented by +'s). The comparative steel articles were produced by a method that used the high batch annealing temperature and the rough temper roll steps found in traditional motor lamination steel processes.

The anisotropic articles (●) of FIGS. 3A and 3B had a composition including (% by weight): 0.003 C, about 0.5 Mn, 1.17 Si, about 0.31 Al, about 0.006 S, 0.011 P, 0.002 N, about 0.035 Sb, and the balance being substantially iron. The steel was hot rolled into strips with an aim ferrite finishing temperature of 1630 or 1525° F. (the actual finishing temperature being about 30–50° F. lower). The strips were coiled at 1000° F., had their thicknesses reduced in a scale breaking mill by about 3%, pickled, and hot band annealed at 1500° F. for 15 to 20 hours. The strips were cold rolled to a 78% reduction in thickness in a tandem mill. The strips were then batch annealed at 1125° F. Temper rolling was then performed with smooth rolls that produced a transfer surface roughness (Ra) in the strips of 6 μin the rolling direction and 17 μin the transverse direction. Next, single strip magnetic test coupons were cut from the strip and subjected to a stress relief anneal to produce the steel articles according to the present invention.

FIG. 3A shows a high permeability exceeding 6000 G/Oe in the rolling direction for the steel articles produced according to the present invention compared to a permeability of less than 3000 G/Oe in the rolling direction for the comparative steel articles. The steel articles of the present invention have high permeabilities across a broad range of angles from the rolling direction. For example, the permeabilities of the steel articles of the present invention are 5000–6200 G/Oe across angles ranging from the rolling direction to 18° from the rolling direction. In contrast, the comparative steel articles have permeabilities of 2500–2900 G/Oe across angles ranging from the rolling direction to 18° from the rolling direction.

FIG. 3B shows a low core loss of under 1.4 W/lb in the rolling direction for the steel articles produced according to the invention compared to a higher core loss of almost 1.7 W/lb in the rolling direction for the comparative steel articles. The steel articles of the present intention have low core losses across a broad range of angles from the rolling direction. The core loss of the present inventions under 1.5 W/lb across angles ranging from the rolling direction to 25° from the rolling direction. In contrast, the comparative steel articles have core losses greater than 1.65 W/lb across angles ranging from the rolling direction to 25° from the rolling direction.

The steel strip of the present invention is smoother than material produced by rough rolls during temper rolling. As a result, a coating may be used to prevent adjacent stacked laminations from sticking during final annealing. The coating is preferably one of those embodied in ASTM A345, which are produced by manufacturers such as Morton Inc. and Ferrotech Corp. The coiled strip is preferably uncoiled and covered by the coating. The coating is dried and the strip is then recoiled. The coiled strip is fit into a punch and motor or transformer shapes are punched out into laminations. The laminations are then stacked and assembled before or after the final annealing.

The final or stress relief annealing was performed by heating the laminations or the magnetic test coupons in a temperature range of 1350–1650° F. for a duration ranging from approximately 45 minutes to 3 hours in a non-oxidizing atmosphere. The preferred final annealing conditions involve soaking for 90 minutes at 1450° F. in an HNX atmosphere having a dew point of from 50–55° F. The final annealing is intended to produce grain sizes as large as possible, for example 300–500μm, and is required to produce the desired {110}<001> grain texture in the steel, and hence improved magnetic properties in the rolling direction.

Figure 4A:
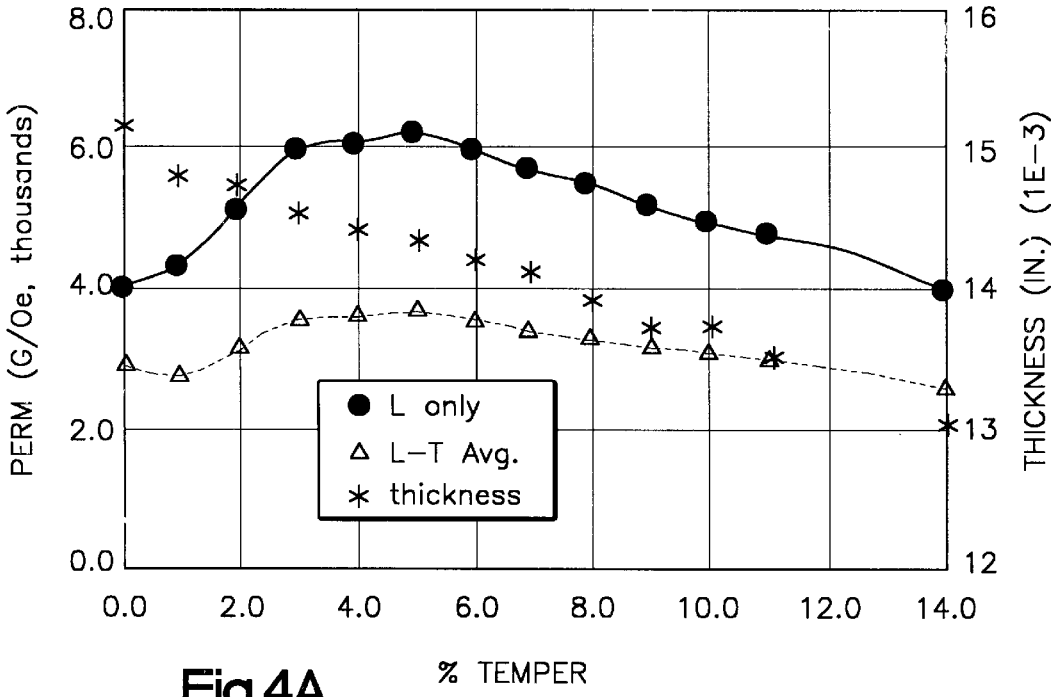
FIGS. 4A and 4B are graphs showing a relationship between temper rolling reductions at which favorable magnetic properties occur, and final strip thickness.
Figure 4B:
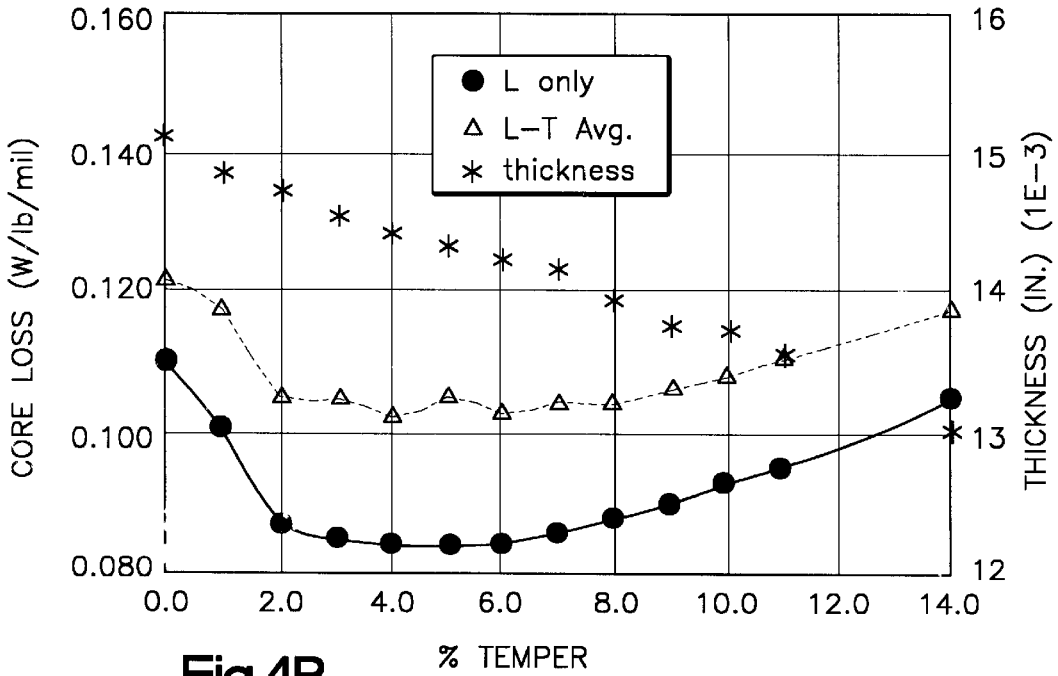

The steel strip shown in FIGS. 4A and 4B was formed by obtaining a slab of steel having a composition comprising (% by weight): .005 C, .54 Mn, .016 P, .006 S, 1.29 Si, .338 Al, 0.002 N, 0.003 Sb, and the balance being substantially iron. The slab was hot rolled at a finishing temperature of 1440° F. The strip was hot band annealed at a strip thickness of 0.86 inch at a temperature of at least 1450° F. The strip was cold rolled at an 83% reduction to a thickness of 0.0147 inch. The strip was batch annealed to a batch anneal grain size of about 13.6 μm (i.e., at about 1100° F.). The strips were temper rolled at reductions in thickness shown in FIGS. 4A and 4B to produce a strip having a final thickness of 0.014 inch. The smooth temper rolls were effective to provide the strip with a transfer surface roughness (Ra) of 10 μin. After stress relief annealing under the conditions described, the strips had the magnetic properties shown in FIGS. 4A and 4B.

FIGS. 4A and 4B illustrate a relationship between temper rolling reductions in strip thickness at which favorable magnetic properties occur, and final strip thickness. Temper rolling may be carried out at smaller reductions in thickness when producing steel strip of smaller thicknesses. The L direction is the rolling direction and the T direction is at 90° from this transverse to the rolling direction. The L direction magnetic properties were much better than the L–T average magnetic properties. A 0.018 inch thick product utilized an optimum temper reduction in thickness of about 8% to maximize permeability and minimize core loss, particularly in the rolling direction. In contrast, FIGS. 4A and 4B show that the most favorable reduction in thickness in connection with a 0.014 inch thick steel strip was about 5%, especially in the rolling direction. The 5% temper reduction was superior to the 8% temper reduction for the thinner 0.014 inch product. In this regard, temper rolling reductions in thickness may decrease by about 0.7% for each 0.001 inch of a reduction in final thickness of the strip (e.g., comparing the 5% temper reduction of the 0.014 inch product to the 8% temper reduction of the 0.018 inch product and assuming a linear relationship).

Although the invention has been described in its preferred form with a certain degree of particularity, it will be understood that the present disclosure of preferred embodiments has been made only by way of example, and that various changes may be resorted to without departing from the true spirit and scope of the invention as hereinafter claimed.

What is claimed is:

1. An electrical steel article characterized by low core loss and high permeability in a rolling direction comprising an electrical steel composition comprising 0.10–0.60% aluminum (Al), up to 2.25% silicon by weight, a grain texture including a {110}<001> orientation and a transfer surface roughness (Ra) of less than 49 μin.

2. The electrical steel article of claim 1 wherein said composition comprises up to 0.01% carbon by weight.

3. The electrical steel article of claim 1 wherein said composition comprises up to 0.04% carbon by weight.

4. The electrical steel article of claim 1 wherein the core loss is not greater than 1.5 W/lb in the rolling direction.

5. The electrical steel article of claim 1 comprising a decrease in permeability not greater than about 5% between a permeability in the rolling direction and a permeability at 10° from the rolling direction in a plane of said article.

6. The electrical steel article of claim 1 wherein said permeability is at least 5000 G/Oe in the rolling direction.

7. The electrical steel article of claim 1 wherein the permeability is at least 5000 G/Oe across angles ranging from the rolling direction to 18° from the rolling direction in a plane of said article.

8. The electrical steel article of claim 1 wherein the core loss is not greater than 1.5 W/lb across angles ranging from the rolling direction to 25° from the rolling direction in a plane of said article.

9. The electrical steel article of claim 1 wherein the transfer surface roughness (Ra) is not greater than 15μin.

10. The electrical steel article of claim 1 wherein said composition comprises (% by weight): up to 0.04 carbon (C), 0.20–2.25 silicon (Si), 0.10–0.60 aluminum (Al), 0.10–1.25 manganese (Mn), up to 0.02 sulphur (S), up to about 0.01 nitrogen (N), up to 0.7 antimony (Sb), up to 0.12 tin (Sn), up to 0.1 phosphorus (P), and the balance being substantially iron.

11. Electrical steel strip capable after annealing to be manufactured into steel articles having a grain texture including a {110}<001> orientation and low core loss and high permeability in a rolling direction, the strip having an electrical steel composition comprising up to 2.25% silicon by weight and 0.10–0.60 aluminum by weight, and a transfer surface roughness (Ra) of less than 49μin.

12. The electrical steel strip of claim 11 wherein the transfer surface roughness (Ra) is not greater than 15 μin.

13. The electrical steel strip of claim 11 wherein said composition comprises up to 0.01% C by weight.

14. The electrical steel strip of claim 11 wherein said composition comprises (% by weight): up to 0.04 carbon (C), 0.20–2.25 silicon (Si), 0.10–0.60 aluminum (Al), 0.10–1.25 manganese (Mn), up to 0.02 sulphur (S), up to about 0.01 nitrogen (N), up to 0.07 antimony (Sb), up to 0.12 tin (Sn), up to 0.1 phosphorus (P), and the balance being substantially iron.

15. An electrical steel article characterized by low core loss and high permeability in a rolling direction comprising an electrical steel composition comprising 0.10–0.60% aluminum (Al), up to 2.25% silicon by weight, a grain texture including a {110}<001> orientation, a transfer surface roughness (Ra) of less than 49 μin, and a decrease in permeability of not greater than about 5% between a permeability in the rolling direction and a permeability at 10° from the rolling direction in a plane of said article, wherein said permeability is at least 5000 G/Oe in the rolling direction.

16. The electrical steel article of claim 15 wherein the transfer surface roughness (Ra) is not greater than 1.5 μin.

17. The electrical steel article of claim 15 wherein said composition comprises (% by weight): up to 0.04 carbon (C), 0.20–2.25 silicon (Si), 0.10–0.60 aluminum (Al), 0.10–1.25 manganeses (Mn), up to 0.02 sulphur (S), up to about 0.01 nitrogen (N), up to 0.07 antimony (Sb), up to 0.12 tin (Sn), up to 0.1 phosphorus (P), and the balance being substantially iron.

18. An electrical steel article characterized by low core loss and high permeability in a rolling direction and made according to a method comprising the steps of:

hot rolling a slab of an electrical steel composition into a strip, said composition comprising up to 2.25% silicon and 0.10–0.60% aluminum by weight;

hot band annealing in a temperature range effective to coarsen grains sufficient to improve magnetic properties in a rolling direction of the strip;

cold rolling;

batch annealing in a temperature range effective to produce a batch annealed grain size of not greater than about 40 μm;

temper rolling with rolls that have a smooth surface effective to provide the strip with a transfer surface roughness (Ra) of less than 49μin; and final annealing to produce said electrical steel article.

19. The electrical steel article of claim 18 wherein said composition comprises (% by weight); up to 0.04 C.

20. The electrical steel article of claim 18 wherein said article has a core loss of not greater than 1.5 W/lb in the rolling direction.

21. The electrical steel article of claim 18 wherein said article has a transfer surface roughness (Ra) of not greater than 15 μin.

22. The electrical steel article of claim 18 comprising a permeability of at least 5000 G/Oe across angles ranging from the rolling direction to 18° from the rolling direction in a plane of said article.

23. The electrical steel article of claim 18 wherein said composition comprises (% by weight): up to 0.04 carbon (C), 0.20–2.25 silicon (Si), 0.10–0.60 aluminum (Al), 0.10–1.25 manganese (Mn), up to 0.02 sulphur (S), up to about 0.01 nitrogen (N), up to 0.07 antimony (Sb), up to 0.12 tin (Sn), up to 0.1 phosphorus (P), and the balance being substantially iron.

24. An electrical steel article characterized by low core loss and high permeability in a rolling direction and made according to a method comprising the steps of:

hot rolling a slab of an electrical steel composition into a strip, hot band annealing in a temperature range effective to coarsen grains sufficient to improve magnetic properties in a rolling direction of the strip, cold rolling, batch annealing in a temperature range effective to produce a batch annealed grain size of not greater than about 40 μm, temper rolling with rolls that have a smooth surface effective to reduce a thickness of the strip to a final thickness and provide the strip with a transfer surface roughness (Ra) of less than 49 μin, wherein an amount by which said strip thickness is reduced is a selected value of about 8%–0.7%X, wherein X is a number of 0.001 inch increments by which said final strip thickness is less than 0.018 inch, and final annealing to produce said electrical steel article, wherein said steel article comprises a permeability of at least 5000 G/Oe in the rolling direction.

25. The electrical steel article of claim 24 wherein the transfer surface roughness (Ra) is not greater than 15 μin.

26. The electrical steel article of claim 24 wherein said article comprises a decrease in permeability of not greater than about 5% between a permeability in the rolling direction and a permeability at 10° from the rolling direction in a plane of said article.

27. The electrical steel article of claim 24 wherein said permeability is at least 5000 G/Oe across angles ranging from the rolling direction to 18° from the rolling direction in a plane of said article.

* * * * *